US007340786B1

(12) United States Patent
Smith

(10) Patent No.: US 7,340,786 B1
(45) Date of Patent: Mar. 11, 2008

(54) LATERAL LEG STRETCHING APPARATUS

(76) Inventor: Oliver A. Smith, 6708 Boulevard of Champions, North Lauderdale, FL (US) 33068

( * ) Notice: Subject to any disclaimer, the term of this patent is extended or adjusted under 35 U.S.C. 154(b) by 0 days.

(21) Appl. No.: 11/408,623

(22) Filed: Apr. 21, 2006

Related U.S. Application Data

(60) Provisional application No. 60/674,518, filed on Apr. 25, 2005.

(51) Int. Cl.
*A47C 17/86* (2006.01)

(52) U.S. Cl. ..... 5/648; 482/131; 482/133; 482/907

(58) Field of Classification Search ..... 482/907, 482/131, 133; 5/648, 682
See application file for complete search history.

(56) References Cited

U.S. PATENT DOCUMENTS 4,445,684 A * 5/1984 Ruff ..... 482/131
5,026,049 A * 6/1991 Goodman ..... 482/131
5,137,504 A * 8/1992 Mangini ..... 482/131
5,277,681 A * 1/1994 Holt ..... 482/112
5,904,641 A * 5/1999 Huang ..... 482/131
6,352,495 B1 * 3/2002 Hsu ..... 482/92
7,108,645 B2 * 9/2006 Lincoln ..... 482/142
2005/0209055 A1 * 9/2005 Anders ..... 482/51
2005/0209068 A1 * 9/2005 Lincoln ..... 482/92
2005/0227837 A1 * 10/2005 Broadbent ..... 482/148

* cited by examiner

*Primary Examiner*—Tara L. Mayo
(74) *Attorney, Agent, or Firm*—John C. Smith

(57) ABSTRACT

A leg stretching apparatus includes an elevation mechanism resting; an elevation structure mounted to the elevation mechanism for lifting and lowering the elevation structure; a first leg support member pivotally connected to the elevation structure and extending from the elevation structure to a support structure in a first direction; and a second leg support member pivotally connected to the elevation structure and extending from the elevation structure to a support means in a second direction; so that operation of the elevation mechanism in one direction lifts the elevation structure so that the first leg support member and the second leg support member pivot progressively downwardly from the elevation structure, and operation of the elevation mechanism in another direction lowers the elevation structure so that the first leg support member and the second leg support member pivot progressively upwardly from the elevation structure.

14 Claims, 2 Drawing Sheets

LATERAL LEG STRETCHING APPARATUS

FILING HISTORY

This application continues from provisional application Ser. No. 60/674,518 filed on Apr. 25, 2005.

BACKGROUND OF THE INVENTION

1. Field of the Invention

The present invention relates generally to the field of physical training and exercise equipment. More specifically the present invention relates to a leg stretching apparatus including an elevation structure mounted to an elevation mechanism for lifting and lowering the elevation structure, a first leg support member hingedly connected to the elevation structure and extending from the elevation structure in a first direction and a second leg support member hingedly connected to the elevation structure and extending from the elevation structure in a second direction. To use the apparatus, the elevation mechanism is operated to lift the elevation structure so that the first and second leg support members pivot downwardly from the elevation structure to rest at their free ends on a floor or other support surface, at an angle below horizontal. The user seats himself or herself on the apparatus by placing one user leg on the first leg support and the other user leg on the second leg support, so that the user legs are spread. Then the user operates the elevation mechanism to lower the elevation structure and thereby progressively pivot the leg support members upwardly toward horizontal, progressively further spreading the user legs to an extent desired by the user. The user optionally can operate the elevation mechanism to raise and lower the elevation structure so that the apparatus spreads and thus laterally stretches the user legs and then moves the user legs toward each other to momentarily relax the user legs, in a repeating sequence.

The elevation structure preferably includes a horizontal platform having a central platform port with port internal threads, and an upright elevation rod rotatably mounted at its lower end to a bearing structure and extending through the platform port, the rod having external rod threads meshing with the port internal threads, and a rod rotation structure in the form of a rod hand grip extending radially outward from the elevation rod for the user to grip and turn in one direction to lift the platform and in the other rotational direction to lower the platform, thereby operating the elevation mechanism. The bearing structure preferably includes a broad bearing support base member. Alternatively, an elevation rod rotation motor assembly is provided to rotate the elevation rod in either direction.

The apparatus preferably additionally includes an elevation guidance structure to permit the elevation structure to be lifted and lowered in a smooth, steady motion without hanging up. The guidance structure preferably includes an upright rectangular frame fitted with a vertical series of horizontal roller axle rods, and a closely spaced series of cylindrical rollers, each roller being mounted on one of the roller axle rods. A lateral end of the elevation structure bears against the rollers so that the rollers provide lateral support to prevent the elevation structure from twisting on the elevation rod.

2. Description of the Prior Art

There have long been exercise devices for building and stretching muscles of the human body. A problem with these prior devices has been that none known to applicant provide means for stretching user legs laterally from each other.

It is thus an object of the present invention to provide a leg stretching apparatus which laterally stretches user legs apart from each other.

It is another object of the present invention to provide such an apparatus which does such stretching in an individually selectable, controlled and progressive movement or series of movements.

It is finally an object of the present invention to provide such an apparatus which is sturdy, safe, durable, reliable and cost effective to manufacture.

SUMMARY OF THE INVENTION

The present invention accomplishes the above-stated objectives, as well as others, as may be determined by a fair reading and interpretation of the entire specification.

A leg stretching apparatus is provided, including an elevation mechanism resting; an elevation structure mounted to the elevation mechanism for lifting and lowering the elevation structure; a first leg support member pivotally connected to the elevation structure and extending from the elevation structure to a support structure in a first direction; and a second leg support member pivotally connected to the elevation structure and extending from the elevation structure to a support means in a second direction; so that operation of the elevation mechanism in one direction lifts the elevation structure so that the first leg support member and the second leg support member pivot progressively downwardly from the elevation structure, and operation of the elevation mechanism in another direction lowers the elevation structure so that the first leg support member and the second leg support member pivot progressively upwardly from the elevation structure. A first hinge preferably pivotally interconnects the first leg support member and the elevation structure and a second hinge pivotally interconnects the second leg support member and the elevation structure.

The leg stretching apparatus preferably additionally includes a first hook structure on the first leg support member for retaining one user leg against the first leg support member and a second hook structure on the second leg support member for retaining the other user leg against the second leg support member. The leg stretching apparatus preferably still additionally includes a foot pad on each of the first leg support member and the second leg support member for providing comfort to user legs. The leg support structure preferably is a support surface such as a floor and the first leg support member has a first leg support member free end and the second leg support member has a second leg support member free end, the apparatus preferably additionally including a first caster wheel mounted to the first leg support member free end to minimize friction as the first leg support member free end moves over the support surface during apparatus operation; and a second caster wheel mounted to the second leg support member free end to minimize friction as the second leg support member free end moves over the support surface during apparatus operation.

The elevation structure preferably includes a horizontal platform having a central platform port with port internal threads; and an upright elevation rod having a rod lower end rotatably mounted to a bearing structure and the rod extending through the platform port, the elevation rod having external rod threads meshing with the port internal threads, and a rod rotation structure for a user to grip and turn in one rotational direction to lift the platform and in the opposing rotational direction to lower the platform, thereby operating the elevation mechanism. The rod rotation structure preferably includes a rod hand grip extending radially outward from the elevation rod.

The leg stretching apparatus preferably additionally includes an elevation guidance structure for guiding the elevation structure during elevation structure lifting and lowering by the elevation mechanism. The guidance structure preferably includes an upright rectangular frame fitted with a vertical series of horizontal roller axle rods, and a closely spaced series of cylindrical rollers, each cylindrical roller being mounted on one of the roller axle rods, so that the elevation structure bears against the cylindrical rollers which provide lateral support and guidance to the elevation structure.

A method of using the leg stretching apparatus includes the steps of: the user seating himself or herself on the apparatus by placing one user leg on the first leg support and the other user leg on the second leg support, such that the user legs are spread; and the user operating the elevation mechanism to lower the elevation structure and thereby progressively pivot the leg support members upwardly toward horizontal, thereby progressively further spreading the user legs to an extent desired by the user.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
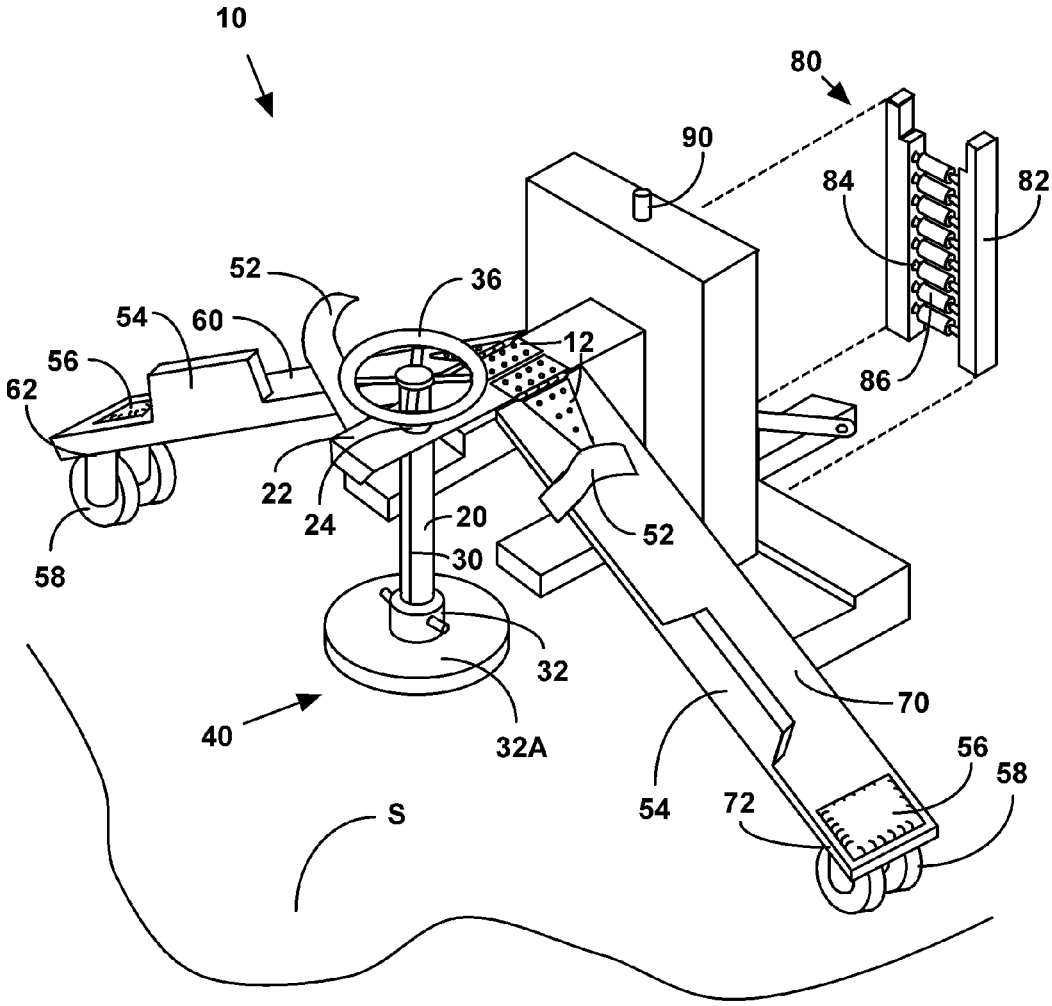
FIG. 1 is a perspective view of the apparatus, with the guidance structure displaced rearwardly to show its several elements.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, a leg stretching apparatus 10 is disclosed including an elevation structure 20 mounted to an elevation mechanism 40 for lifting and lowering the elevation structure 20, a first leg support member 60 pivotally connected to the elevation structure 20 and extending from the elevation structure 20 in a first direction and a second leg support member 70 pivotally connected to the elevation structure 20 and extending from the elevation structure 20 in a second direction. A hinge 12 preferably interconnects each leg support member with the elevation structure 20. The first and second leg support members 60 and 70 respectively preferably each include a leg hook 52 and an adjustable leg brace 54 for holding each user leg in place on top of and longitudinally along its respective leg member 60 or 70. A foot pad 56 preferably is provided on the upper surface of each leg support member free end 62 and 72 for user comfort. A caster wheel 58 preferably is mounted to the lower surface of each leg support member free end 62 and 72 to rest on a floor or other support surface S and thereby minimize friction as the leg support member free ends 62 and 72 move over support surface S during apparatus 10 operation. A backrest mount 90 preferably is provided for optionally securing a backrest (not shown) onto apparatus 10.

The elevation structure 20 preferably includes a horizontal platform 22 having a central platform port 24 with port internal threads, and an upright elevation rod 30 rotatably mounted at its lower end to a bearing structure 32 and extending through the platform port 24, the elevation rod 30 having external rod threads meshing with the port internal threads, and a rod rotation structure 36 in the form of a rod hand grip extending radially outward from the elevation rod 30 upper end for the user to grip and turn in one rotational direction to lift platform 22 and in the other rotational direction to lower platform 22, thereby operating the elevation mechanism 40. The bearing structure 32 preferably includes a broad bearing support base member 32*a* for stabilizing apparatus 10 on support surface S. Alternatively, an elevation rod rotation motor assembly (not shown) is provided to rotate the elevation rod 30 in either rotational direction.

Apparatus 10 preferably additionally includes an elevation guidance structure 80 to permit the elevation structure 20 to be lifted and lowered in a smooth, steady motion without twisting and binding on elevation rod 30. The guidance structure 80 preferably includes an upright rectangular frame 82 fitted with a vertical series of horizontal roller axle rods 84, and a closely spaced series of cylindrical rollers 86, each roller 86 being mounted on one of the roller axle rods 84. A rearward end of the elevation structure 20 bears against the rollers 86 so that the rollers 86 provide lateral support to the elevation structure 20.

Second Preferred Embodiment

Figure 2:
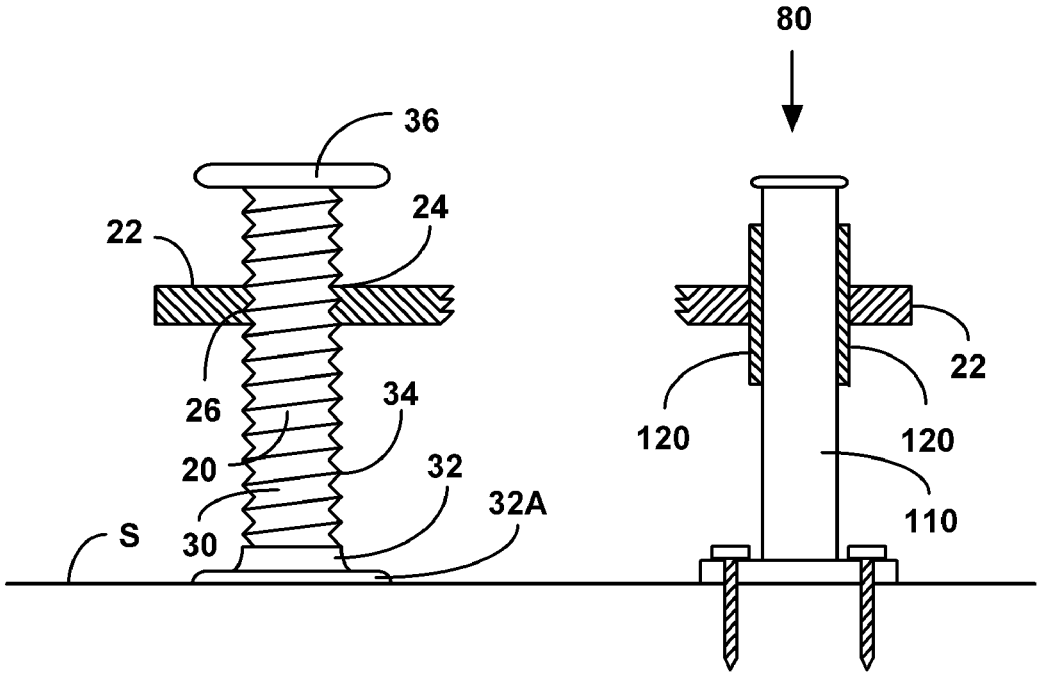
FIG. 2 is a broken away, cross-sectional side view of the elevation structure platform through the platform port, and a side view of the elevation rod passing through the platform port, showing the port internal threads and the rod external threads, and also showing the upright guide rod of the second embodiment mounted to the support surface with screws and slidably passing through the upright tubular fitting.

FIG. 2 shows an alternative to the above-described elevation guidance structure 80. The elevation guidance structure 80 of the second embodiment includes an upright guide rod 110 mounted to the support surface S slidably passing through an upright tubular fitting 120 with close tolerance, the tubular fitting being fixedly connected to and passing through elevation structure platform 22.

Method

To use apparatus 10, the elevation mechanism 40 is operated to lift the elevation structure 20 so that the first and second leg support members 60 and 70 pivot downwardly from the elevation structure 20 while resting continually at their leg support member free ends 62 and 72 on support surface S, at an increased angle below horizontal. The user seats himself or herself on the apparatus 10 by placing one user leg on the first leg support 60 and the other user leg on the second leg support 70, so that the user legs are spread apart. Then the user operates the elevation mechanism 40 to lower the elevation structure 20 and thereby progressively pivot the leg support members 60 and 70 upwardly toward horizontal, progressively further spreading the user legs to an extent desired by the user. The weight of the user assists in the user leg spreading and stretching by helping keep the user fully and firmly seated on apparatus 10. The user optionally can operate the elevation mechanism 40 to lift and lower the elevation structure 20 so that apparatus 10 spreads and thus laterally stretches the user legs, and then moves the user legs toward each other to momentarily relax the user legs, in a repeating sequence.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A leg stretching apparatus, comprising:

an elevation mechanism resting;

an elevation structure mounted to said elevation mechanism for lifting and lowering said elevation structure;

a first leg support member having a proximal end that is pivotally connected to said elevation structure and a distal end that extends outward from said elevation structure, the distal end slidably rests on a support surface such that when the elevation structure is raised or lowered, the first leg support member pivoting in relation to the elevation structure;

and a second leg support member having a proximal end that is pivotally connected to said elevation structure and a distal end that extends outward from said elevation structure, the distal end slidably rests on a support surface such that when the elevation structure is raised or lowered, the first leg support member pivoting in relation to the elevation structure;

such that operation of said elevation mechanism in one direction lifts said elevation structure such that said first leg support member and said second leg support member pivot progressively downwardly from said elevation structure, and operation of said elevation mechanism in another direction lowers said elevation structure such that said first leg support member and said second leg support member pivot progressively upwardly from said elevation structure.

2. The leg stretching apparatus of claim 1, wherein a first hinge pivotally interconnects said first leg support member and said elevation structure and a second hinge pivotally interconnects said second leg support member and said elevation structure.

3. The leg stretching apparatus of claim 1, additionally comprising a first hook means on said first leg support member for retaining one user leg against said first leg support member and a second hook means on said second leg support member for retaining the other user leg against said second leg support member.

4. The leg stretching apparatus of claim 1, additionally comprising a foot pad on each of said first leg support member and said second leg support member for providing comfort to user legs.

5. The leg stretching apparatus of claim 1, wherein said rod rotation structure comprises a rod hand grip extending radially outward from said elevation rod.

6. The leg stretching apparatus of claim 1, additionally comprising an elevation guidance structure for guiding said elevation structure during elevation structure lifting and lowering by said elevation mechanism.

7. A leg stretching apparatus, comprising:

an elevation mechanism resting;

an elevation structure mounted to said elevation mechanism for lifting and lowering said elevation structure;

a first leg support member pivotally connected to said elevation structure and extending from said elevation structure to a support means in a first direction;

and a second leg support member pivotally connected to said elevation structure and extending from said elevation structure to a support means in a second direction;

such that operation of said elevation mechanism in one direction lifts said elevation structure such that said first leg support member and said second leg support member pivot progressively downwardly from said elevation structure, and operation of said elevation mechanism in another direction lowers said elevation structure such that said first leg support member and said second leg support member pivot progressively upwardly from said elevation structure;

wherein the leg support means is a support surface and wherein said first leg support member has a first leg support member free end and said second leg support member has a second leg support member free end, additionally comprising:

a first caster wheel mounted to said first leg support member free end to minimize friction as said first leg support member free end moves over the support surface during apparatus operation; and a second caster wheel mounted to said second leg support member free end to minimize friction as said second leg support member free end moves over the support surface during apparatus operation.

8. A leg stretching apparatus, comprising:

an elevation mechanism resting;

an elevation structure mounted to said elevation mechanism for lifting and lowering said elevation structure;

a first leg support member pivotally connected to said elevation structure and extending from said elevation structure to a support means in a first direction;

and a second leg support member pivotally connected to said elevation structure and extending from said elevation structure to a support means in a second direction;

such that operation of said elevation mechanism in one direction lifts said elevation structure such that said first leg support member and said second leg support member pivot progressively downwardly from said elevation structure and operation of said elevation mechanism in another direction lowers said elevation structure such that said first leg support member and said second leg support member pivot progressively upwardly from said elevation structure wherein said elevation mechanism further comprises:

a horizontal platform having a central platform port with port internal threads;

and an upright elevation rod having a rod lower end rotatably mounted to a bearing structure and said rod extending through said platform port, said elevation rod having external rod threads meshing with said port internal threads, and a rod rotation structure for a user to grip and turn in one rotational direction to lift said platform and in the opposing rotational direction to lower said platform thereby operating the elevation mechanism.

9. The leg stretching apparatus of claim 8, wherein a first hinge pivotally interconnects said first leg support member and said elevation structure and a second hinge pivotally interconnects said second leg support member and said elevation structure.

10. The leg stretching apparatus of claim 8, additionally comprising a first hook means on said first leg support member for retaining one user leg against said first leg support member and a second hook means on said second leg support member for retaining the other user leg against said second leg support member.

11. The leg stretching apparatus of claim 8, additionally comprising a foot pad on each of said first leg support member and said second leg support member for providing comfort to user legs.

12. The leg stretching apparatus of claim 8, wherein said rod rotation structure comprises a rod hand grip extending radially outward from said elevation rod.

13. The leg stretching apparatus of claim 8, additionally comprising an elevation guidance structure for guiding said elevation structure during elevation structure lifting and lowering by said elevation mechanism.

14. A leg stretching apparatus, comprising:

an elevation mechanism resting;

an elevation guidance structure for guiding said elevation structure during elevation structure lifting and lowering by said elevation mechanism;

an elevation structure mounted to said elevation mechanism for lifting and lowering said elevation structure;

a first leg support member pivotally connected to said elevation structure and extending from said elevation structure to a support means in a first direction;

and a second leg support member pivotally connected to said elevation structure and extending from said elevation structure to a support means in a second direction;

such that operation of said elevation mechanism in one direction lifts said elevation structure such that said first leg support member and said second leg support member pivot progressively downwardly from said elevation structure, and operation of said elevation mechanism in another direction lowers said elevation structure such that said first leg support member and said second leg support member pivot progressively upwardly from said elevation structure;

wherein said guidance structure comprises an upright rectangular frame fitted with a vertical series of horizontal roller axle rods, and a closely spaced series of cylindrical rollers, each said cylindrical roller being mounted on one of said roller axle rods;

such that said elevation structure bears against said cylindrical rollers which provide lateral support and guidance to said elevation structure.

* * * * *